US006070755A

United States Patent [19]

Evans et al.

[11] Patent Number: 6,070,755

[45] Date of Patent: Jun. 6, 2000

[54] LID WITH FOLDING SIDE TABS FOR HOT BEVERAGE CUP

[75] Inventors: Michael G Evans, Cincinnati, Ohio; John Kevin Bruce, Florence, Ky.

[73] Assignee: Waddington North America, Inc., Covington, Ky.

[21] Appl. No.: 09/357,497

[22] Filed: Jul. 20, 1999

[51] Int. Cl.[7] ..... B65D 41/26; A47G 19/22

[52] U.S. Cl. ..... 220/793; 220/710.5; 220/713; 220/737; 229/403; 229/404

[58] Field of Search ..... 220/780, 784, 220/786, 788, 324, 793, 805, 212, 212.5, 703, 710.5, 711, 713–717, 730, 737–740, 752, 753, 755, 756, 759, 768, 769, 772, 903, 918, 921, 592.17, 592.2, 592.24, 592.23, 592.25; 222/183, 131, 475.1; 229/403, 404, 400, 906.1; D7/900, 511, 317, 321, 322

[56] References Cited

U.S. PATENT DOCUMENTS

| | | | |
|---|---|---|---|
| 3,546,752 | 12/1970 | Sargent | 220/324 |
| 3,589,551 | 6/1971 | Haggbom . | |
| 3,688,942 | 9/1972 | Mitchell et al. . | |
| 4,049,187 | 9/1977 | Florian . | |
| 4,589,569 | 5/1986 | Clements | 220/713 X |
| 4,684,024 | 8/1987 | Ebrahim et al. | 220/324 X |
| 4,721,210 | 1/1988 | Lawrence et al. . | |
| 4,899,902 | 2/1990 | Demars | 220/254 |
| 4,986,438 | 1/1991 | Borst | 220/324 X |
| 5,203,490 | 4/1993 | Roe . | |
| 5,253,781 | 10/1993 | Van Melle et al. | 220/713 |
| 5,348,181 | 9/1994 | Smith et al. . | |
| 5,538,154 | 7/1996 | Von Holdt | 220/784 X |
| 5,607,076 | 3/1997 | Anthony . | |
| 5,752,646 | 5/1998 | Sandstrom | 229/400 X |
| 5,765,716 | 6/1998 | Cai et al. | 220/740 |
| 5,894,952 | 4/1999 | Mendenhall et al. | 220/713 |

*Primary Examiner*—Nathan J. Newhouse
*Attorney, Agent, or Firm*—Vernon C. Maine; Scott J. Asmus

[57] ABSTRACT

A disposable plastic lid with folding side tabs for holding and drinking from hot beverage cups. The lid is applied in the usual fashion to the pre-filled beverage cup. A shorter tab adjacent the drinking spout accommodates the user's thumb. A longer tab opposite the spout accommodates a multi-finger opposing grip. There is a additional top side finger grip in the lid opposite the drinking spout. The side tabs are attached by two point hinge mechanisms with a slit running between the hinge points along the radius of the flange dividing the tab from the flange. The flange retains its full diameter about the circumference of the lid. The tabs are pre-formed with a raised rib pattern and shaped to fit the curvature of the sidewall of the cup. The two point hinge allows the tabs to be folded down and inward below the lid flange into contact with the sidewall of the cup, providing thermal insulation to the user's grip. The two point hinge mechanism and conforming sidetab minimizes structure protruding beyond that of the lid flange.

12 Claims, 2 Drawing Sheets

LID WITH FOLDING SIDE TABS FOR HOT BEVERAGE CUP

TECHNICAL FIELD OF THE INVENTION

This invention most generally relates to lids for disposable hot beverage cups, and more particularly to disposable lids with folding side tabs, for capping, holding and drinking from hot beverage cups.

BACKGROUND OF THE INVENTION

Most consumers want their hot beverages to be served just that way; hot. However, coffee and other hot beverages are often served by vendors at temperatures sufficiently high to cause severe discomfort or even burns, if the vendor and/or consumer does not take suitable precautions. For economic reasons, disposable hot beverage cups are typically made of light paper board or relatively thin foam wall construction, providing minimal thermal protection to the user's grip. A variety of available lid designs offers the vendor some choices as to what total container system best serves both the vendor's interest and the consumer's desire.

Most contemporary disposable lids are constructed as a thin wall, molded plastic structure sized for a press fit onto the top of standard size cups. Some lids provide additional structure elements such as ridges, vent holes, and openings through which the coffee or hot beverage can be consumed without being removed. Some lid designs have incorporated folding side tabs intended to provide thermal protection for the user's grip and/or to lock the lid on by gripping the rim or bead that terminates the top edge of the cup wall.

However, most users are forced to resort to using trays, double cups, fluted insulating booties or wraps sometimes referred to as "Java Jackets", bags, or to gripping the cup and lid by the bottom flange and edge of lid with minimal contact area and pressure, in order to avoid being burned. Also, the double cup and java jacket solutions add significant extra cost to the container component of the vendor's cost.

The prior patent art of disposable hot beverage cups and lids provides further context for the introduction of the invention, illustrating the efforts other inventors have made to deal with the problem. In particular, Smith's U.S. Pat. No. 5,348,181 discloses a disposable lid for hot beverage cups, that incorporates opposing side folding tabs that work off a snap/fold hinge mechanism to fold a centerline vertical bead molded into the tab into contact with the wall of the cup, locking the lid to the cup rim in the process. The area of contact of the tab with the cup wall is minimal, being a single line, and clearly should minimize the rate conduction of heat directly from the cup wall into the tab.

However, the geometry of the Smith tab hinge and others like it leaves an excessively protruding structure at each tab. The hinge structure in the tabs down position extends sufficiently far out outward from the edge of the lid to cause a problem in packing and carriage of cups capped with such lids. It is most noticeable when using trays or bags to carry more than one cup. It increases the likelihood of an inadvertent catching of the extending hinge structure by hand or other objects being moved, which could uncap and/or overturn the cup.

A further problem with the Smith tab is the possible deformation of the cup wall by gripping pressure of the user, due to the thin, lineal pattern of wall contact. This poses a risk of rupture or spillage due to constricted volume. Clearly, there is room for improvement in tabbed lid designs.

SUMMARY OF THE INVENTION

The invention, simply stated, is a disposable lid with folding sidetabs, for capping, holding and drinking from hot beverage cups. The primary goal of the invention is to reduce the amount of heat transferred from the cup to the user's hand while minimizing the packaging required to perform this function. Among the noteworthy features of the invention is a two point tab hinge system that allows for a closely fitting sidewall tab and minimal outward extension of hinge support structure from the lid flange.

It is therefore an object of the invention to provide a lid for a beverage cup, having a top section configured for a press fit over the rim of the cup, and folding sidewall tabs, each tab attached by a two point hinge mechanism to the edge of the lid, where the two point hinge mechanism has two spaced apart hinge segments on a common axis so that the tabs can be downwardly and inwardly folded into contact with the sidewall of said cup without excessive hinge or tab structure protruding outwardly from the lid and cup, thus introducing only a minimal extension to the normal cup diameter.

It is a further object of the invention to have a second of two opposing tabs longer than the first tab, where the first tab is attached to the lid adjacent to the drinking opening for a thumb grip, and the second tab is opposite the first tab and able to be gripped by two or three fingers. This provides a cue for proper rotational alignment of the cup for gripping, and further minimizes the material content; always important in a disposable product.

It is a yet further object to have the lid or top section further configured with a top finger grip opposite the drinking opening to enable a downward component to the user's grip.

Further objects and advantages will be apparent from the figures and detailed description that follow.

DESCRIPTION OF THE PREFERRED EMBODIMENT

The following is a description of a preferred embodiment, offered as illustrative of the invention but not restrictive of the scope of the invention.

Figure 1:
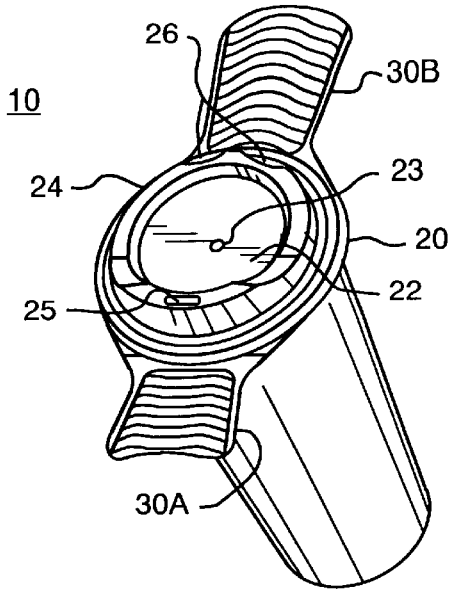
FIG. 1 is an perspective view of the preferred embodiment of the lid, with the two folding tabs in the unfolded position, extending outward from the lid.
Figure 2:
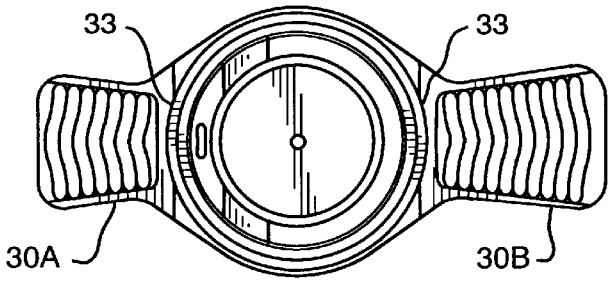
FIG. 2 is a top view of the lid of FIG. 1 on a cup, with the tabs as yet still unfolded.
Figure 3:
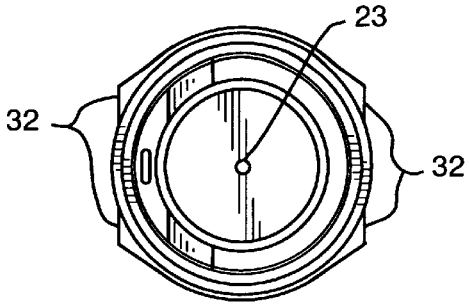
FIG. 3 is a top view of the lid of FIG. 1 on a cup, after the tabs were folded downward beneath the lid into contact with the cup wall.
Figure 5:
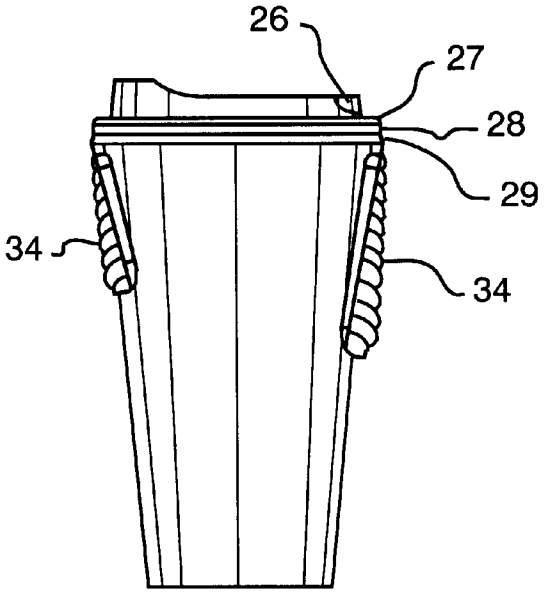
FIG. 5 is a side elevation of the lid and cup of FIG. 3.
Figure 4:
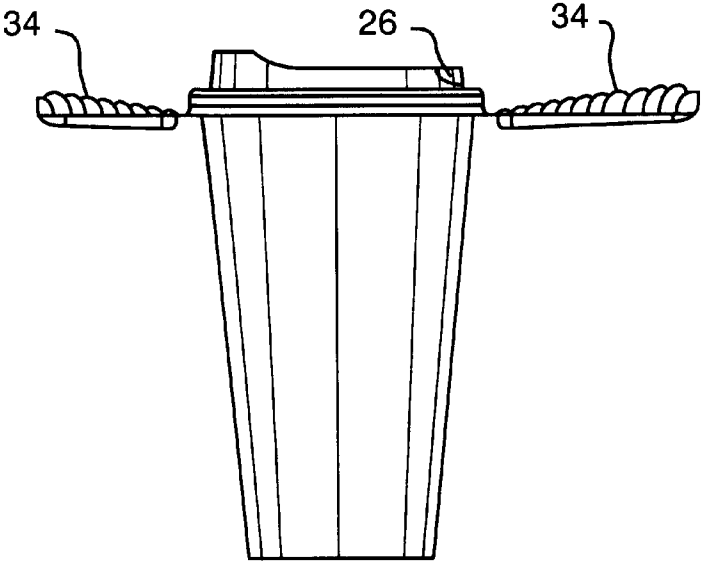
FIG. 4 is a side elevation of the lid and cup of FIG. 2.

Referring to FIGS. 1–5, there is illustrated a monolithic, molded, disposable beverage cup lid and sidewall tab system 10 for installation on a pre-filled disposable beverage cup. The lid and tab system consists of three principal structural elements; lid 20, and folding sidewall tabs 30A and 30B.

Lid 20 consists of five elements; center section 22, a raised channel section 24, a cup rim fitting section 27, and a skirt 28. The center section is concave, with a dimpled center vent/drain pinhole 23. The circular raised channel section 24 is about ⅜ inches wide, and has a further upward extending 60 degree portion of the channel with a small, elongate hole on top, functioning as the drinking spout 25. The elongate hole is preferred over a smaller, round hole, as is often found in other lids.

There are a pair of adjacent finger indentations 26, on the outboard edge of the raised channel 24 opposite the spout 25, providing for enhanced top or lid grip by one finger of either hand when holding the cup. This provides a downward component to the user's grip to assure the lid/cup fit is maintained.

The cup rim fitting section 27 is circular and closely conforming to the rim size of the cups for which the lid is intended, being applied thereto with a pressing, snap on fit. The juncture between rim fitting section 27 and raised channel section 24 forms a slight trough which is helpful to collect and contain minute amounts of overflow from the spout. The skirt section 28 is outboard and downward extending from the rim fitting section 27, terminating in a circumfrential flange 29, which adds rigidity to the lid.

The semi-rigid folding sidewall tabs 30A and 30B are substantially similar in all respects, having similar features and function, except that tab 30A is shorter, intended only for gripping by the user's thumb, and is therefore located adjacent to drinking spout 25. Tab 30B, in distinction, is somewhat longer, intended for gripping by two or three fingers of the same hand to complete the grip, and is therefore located opposite drinking spout 25 and tab 30A. It will be apparent that the different tab lengths promotes an easily detectable correct rotational alignment for gripping, while the semicircular symmetry keeps the lid equally usable with either the left or right hand.

Each tab is hingedly connected to lid 20 at two spaced apart hinge points 32 on flange 29 of skirt 28, with a connecting cut line or slit 33 running along the radius of flange 29. The hinges are fabricated as integral to the lid and tabs in the molds and molding process. The physical properties of the material used, and the hinge geometry, are sufficient to provide a hinge function adequate for the intended limited use and disposable nature of the device. Once depressed so as to separate and open the slit line between the hinge points, the tabs are unconstrained with respect to the lid and cup, and are in firm contact with the cup wall only while being gripped by the user.

The radial length of slit 33 between hinge points 32 of each tab is about 45 degrees for the preferred embodiment. The two hinge points 32 of each tab share a common hinge line of rotation, which provides for the tab to be readily folded down and under flange 29 for a close, conforming fit with the sidewall of the cup. The constant radius of slit 33 maintains the integrity of flange 29.

Tabs 30A and 30B are molded with a raised rib pattern 34, and are further configured with the same underside profile or curvature as the radius of the cup sidewall. Rib pattern 34 provides added thermal isolation to the user's grip. The conforming curvature of the tab presents a generous cross sectional area of rib edge pattern for distributed contact with the cup sidewall.

In summary, the overall geometry of the spaced apart hinge points 32, with 45 degree slit 33, and conforming underside profile of tabs 30A and 30B, provides for a conforming fit of the folded under tabs against the cup sidewall, with minimal extruding hinge and tab structure beyond the total volume and shape of the lid and cup.

To those skilled in the art, the invention admits of many variations. As examples, the number and size of the tabs can be varied for a different grip, or the lid and hinge geometry can be varied to fit a variety of disposable cup shapes and sizes, either or both while maintaining minimal overall structural volume and the integrity of the lid skirt and flange sections.

As another example, there is a lid for a beverage cup with a top section having an outer skirt and flange larger than the rim diameter of a beverage cup and configured for a press fit over the rim of the cup. The top section is configured with an opening through which the beverage in the cup may be consumed by drinking. The lid has two folding sidewall tabs, each said tab attached by a two point hinge mechanism to the flange at opposing sides of the lid. The two point hinge has two spaced apart hinge segments on a common axis with a slit running there between dividing the tab from the flange, with the slit conforming to the flange diameter of the lid. The tabs are thereby downwardly and inwardly foldable beneath the flange into contact with the sidewall of the cup, and each tab is preformed to conform to the outer radius of the sidewall of the cup.

As other examples, the tabs are pre-formed with a distributed raised rib pattern. The first of two tabs is shorter than the second, the first tab being attached to the flange adjacent to the drinking spout or opening. The top section is configured with a top finger grip opposite the spout or opening. And the lid may be fabricated as a one piece, thin wall, polymeric structure.

As a further example, there is a snap on lid with folding sidetabs for capping and holding a wide mouth container, with a top section having an outer skirt and flange and configured for a press fit over the rim of the container, and at least two folding sidewall tabs where the tabs are equally spaced about and attached by a respective two point hinge mechanism to the flange. The two point hinge mechanism having two spaced apart hinge segments on a common axis, allows the tabs to be downwardly and inwardly foldable beneath the flange into contact with the sidewall of the container, and each tab is preformed to conform to the outer radius of the sidewall.

As yet further examples, the tabs are pre-formed with a distributed raised rib pattern. The first of the tabs is shorter than a second tab, and the first tab is attached to the flange adjacent to an opening in the top section through which liquid in the container may be poured, drunk, pumped, sucked by a straw, or otherwise extracted. And the lid can be fabricated as a one piece, thin wall, polymeric structure.

In the specification and the claims appended hereto, the applicant has described and illustrated a preferred embodiment and other variations of the invention, and disclosed the best mode by which the invention may be practiced.

We claim:

1. A lid for a beverage cup with a circular rim comprising a circular top section having an outer skirt and flange larger than the rim diameter of said beverage cup and configured for a press fit over the rim of said cup, said top section further configured with an opening through which a beverage in said cup may be consumed by drinking, and two folding sidewall tabs, each said tab attached by a two point hinge mechanism to said flange at opposing sides of said lid, said two point hinge mechanism comprising two spaced apart hinge segments on a common axis with a slit running there between dividing said tab from said flange, said slit conforming to the flange diameter of said lid, said tabs being thereby downwardly and inwardly foldable beneath said flange into contact with the sidewall of said cup, each said tab shaped to conform to the outer radius of said sidewall of said cup.

2. The lid for a beverage cup according to claim 1, said tabs being formed with a distributed raised rib pattern.

3. The lid for a beverage cup according to claim 1, a first of said two tabs being shorter than a second, said first tab attached to said flange adjacent to said opening.

4. The lid for a beverage cup according to claim 3, said top section further configured with a top finger grip opposite said opening and said first of said two tabs.

5. The lid for a beverage cup according to claim 1, said lid fabricated as a one piece, thin wall, polymeric structure.

6. A snap on lid for capping and holding a wide mouth container comprising a circular top section having an outer skirt and flange and configured for a press fit over a circular rim of said container, and at least two folding sidewall tabs, said tabs equally spaced about and attached by a respective two point hinge mechanism to said flange, said two point hinge mechanism comprising two spaced apart hinge segments on a common axis with a void therebetween, said tabs being thereby downwardly and inwardly foldable beneath said flange into contact with the sidewall of said container, each said tab shaped to conform to the outer radius of said sidewall.

7. The snap on lid according to claim 6, said tabs being formed with a distributed raised rib pattern.

8. The snap on lid according to claim 6, a first of said tabs being shorter than a second of said tabs, said first tab attached to said flange adjacent to an opening in said top section through which a liquid in said container may be extracted.

9. The snap on lid according to claim 6, said lid fabricated as a one piece, thin wall, polymeric structure.

10. A lid for a beverage cup with a circular rim comprising a circular top section having an outer skirt and flange larger than the rim diameter of said beverage cup and configured for a press fit over the rim of said cup, said top section further configured with an opening through which a beverage in said cup may be consumed by drinking, and two folding sidewall tabs, each said tab attached by a two point hinge mechanism to said flange at opposing sides of said lid, said two point hinge mechanism comprising two spaced apart hinge segments on a common axis with a slit running there between dividing said tab from said flange, said slit conforming to the flange diameter of said lid, said tabs being thereby downwardly and inwardly foldable beneath said flange into contact with the sidewall of said cup, each said tab shaped to conform to the outer radius of said sidewall of said cup, said tabs being formed with a distributed raised rib pattern, said top section further configured with a top finger grip opposite said opening.

11. The lid for a beverage cup according to claim 10, a first of said two tabs being shorter than a second, said first tab attached to said flange adjacent to said opening.

12. The lid for a beverage cup according to claim 10, said lid fabricated as a one piece, thin wall, polymeric structure.

* * * * *